US010113833B2

(12) United States Patent
Alfaro

(10) Patent No.: US 10,113,833 B2
(45) Date of Patent: Oct. 30, 2018

(54) APPARATUS FOR SECURING A HOLSTER

(71) Applicant: Luis Alfaro, Gary, IN (US)

(72) Inventor: Luis Alfaro, Gary, IN (US)

( * ) Notice: Subject to any disclaimer, the term of this patent is extended or adjusted under 35 U.S.C. 154(b) by 0 days.

(21) Appl. No.: 15/297,247

(22) Filed: Oct. 19, 2016

(65) Prior Publication Data

US 2017/0160050 A1 Jun. 8, 2017

Related U.S. Application Data

(60) Provisional application No. 62/386,422, filed on Dec. 2, 2015.

(51) Int. Cl.

| | |
|---|---|
| ***F41C 33/00*** | (2006.01) |
| ***F41C 33/04*** | (2006.01) |
| ***G08B 13/14*** | (2006.01) |
| *F41C 33/02* | (2006.01) |

(52) U.S. Cl.

CPC ..... *F41C 33/008* (2013.01); *G08B 13/14* (2013.01); *A45F 2200/0591* (2013.01); *F41C 33/029* (2013.01); *F41C 33/04* (2013.01); *F41C 33/041* (2013.01)

(58) Field of Classification Search

CPC .... F41C 33/006; F41C 33/029; F41C 33/041; F41C 33/04; A45F 5/021; A45F 2200/0591

See application file for complete search history.

(56) References Cited

U.S. PATENT DOCUMENTS

| | | | | | |
|---|---|---|---|---|---|
| 2,731,179 | A * | 1/1956 | Bennett | A45F 5/021 | 224/272 |
| 2,789,742 | A * | 4/1957 | De Salvo | A45F 5/021 | 224/271 |
| 3,749,294 | A * | 7/1973 | Johnston | A01K 97/10 | 224/200 |
| 3,963,156 | A * | 6/1976 | Perrin | A45F 5/021 | 224/268 |
| 4,121,743 | A * | 10/1978 | Burton | F41B 5/1461 | 124/88 |
| 5,630,535 | A * | 5/1997 | Valenti | A45F 5/02 | 224/191 |
| 5,683,067 | A * | 11/1997 | Slykas | A47K 13/165 | 248/309.1 |
| 6,129,251 | A * | 10/2000 | Lajoie | A01K 97/10 | 224/197 |
| D507,959 | S * | 8/2005 | Mottini | D8/354 | |
| D586,206 | S * | 2/2009 | Robbins, III | D8/380 | |
| 7,714,720 | B2 * | 5/2010 | Hietanen | F41A 17/063 | 224/243 |
| 9,360,276 | B1 | 6/2016 | Meek | | |
| D789,184 | S * | 6/2017 | Stanley | D8/363 | |
| 2014/0162584 | A1 * | 6/2014 | Cope | F41C 33/0227 | 455/404.1 |
| 2015/0192388 | A1 * | 7/2015 | Blach | F41C 33/041 | 224/660 |
| 2015/0256990 | A1 * | 9/2015 | Vilrokx | H04W 4/22 | 455/404.1 |

(Continued)

*Primary Examiner* — Justin Larson

(74) *Attorney, Agent, or Firm* — Daniel Zamudio

(57) ABSTRACT

An apparatus that mounts to a surface and securely holds a holster and firearm by allowing the clip of the holster to pass over a landing on the apparatus. The landing being set off from the surface to which the apparatus is mounted.

10 Claims, 3 Drawing Sheets

(56) References Cited

U.S. PATENT DOCUMENTS

| | | | | |
|---|---|---|---|---|
| 2015/0369559 | A1* | 12/2015 | Del Rosario | F41C 33/029 340/686.4 |
| 2016/0153746 | A1 | 6/2016 | Higgins | |
| 2016/0377373 | A1* | 12/2016 | Feldstein | F41C 33/029 42/1.01 |
| 2017/0016696 | A1* | 1/2017 | Koskan | F41C 33/0209 |
| 2017/0160050 | A1* | 6/2017 | Alfaro | F41C 33/008 |

* cited by examiner

APPARATUS FOR SECURING A HOLSTER

CROSS-REFERENCE TO RELATED APPLICATIONS

The present application claims the benefit of U.S. Provisional Patent Application No. 62/386,422, filed Dec. 2, 2015, the entirety of which is hereby incorporated by reference, including its specification.

BACKGROUND

The United States government recently prepared a report on lost and stolen guns. Lost and stolen firearms pose a substantial threat to public safety and are an inconvenience to the gun owner. Lost or stolen guns can be transferred to others who commit crimes, and create an unregulated secondary market for firearms, including a market for those who are prohibited by law from possessing a gun. The number of firearms reported lost or stolen by private individuals in 2012 totaled more than 190,000 nationwide.

Misplacing a gun can wreak havoc on a family from unintentional injuries. People of all age groups can die from unintentional firearm injuries, particularly when they live in states with more guns. Alarmingly, a federal government study of unintentional shootings found that 8% of such shooting deaths resulted from shots fired by children under the age of six. Gun owners need a way to assure their guns are placed in a place that is known to them and safe from unauthorized access. Yet the gun should be in a place that allows the owner quick access without having to wear the gun all the time in a holster.

One method of providing a safe, known, and easily accessible place for a gun is a holder. There are many gun holders on the market. Some mount to walls, car steering wheels, under tables, and any other multitude of locations. Holders of this sort require the gun to be removed from its holster. This increases the chance of an accident because the gun is being handled by the owner, or anyone that is placing the gun in the holder. Another way to attempts are made to assure the safe placement of guns is through the use of a gun safe, however gun safes do not provide easy access to the firearm.

Explaining an example of this problem further, in a typical scenario, a gun owner arrives home at the end of a day carrying a firearm in a holster attached to his or her body. Upon arriving home, the person unclips the gun and holster from their belt, then places the holster and gun in the first place available. This is a habit that is similar to placing ones keys on the nearest counter when coming into the house but is a dangerous habit for placement of a holster and gun. Many gun owners realize the importance of keeping the gun in a safer location and will place the holster in a higher spot, such as on top of their refrigerator. However, the habit of placing a holster and gun in the nearest spot is dangerous because it places the gun in a location where it can be taken by others easily or is in a place that may be forgotten by the owner. A safer gun is one that is in a location known to its owner at all times.

Clearly, a gun owner must consciously remember to place their holster and gun in a place that is easily accessible, rememberable, and in as safe a place as possible. Doing otherwise places the gun in a position that can be dangerous to the owner and to public safety.

Information relevant to attempts to address these problems can be found in U.S. Pat. No. 9,360,276 B1. However, this reference suffers from one or more of the following disadvantages: it requires mounting to a vertical surface and it requires reconfiguration for left or right handed gun owners.

For the foregoing reasons, there is a need in the industry for an apparatus that provides an easy means for gun owners to clip their holster and gun. That provides a place that is the safe from unauthorized access. That provides a safe place for the holster and gun to be stored but allows for easy access by the owner. Such an apparatus will greatly minimize the dangers to families from unintentional shootings, and increase the safety to the public by preventing lost or stolen firearms.

SUMMARY

The present invention is directed to an apparatus, the utility of which is to provide a safe and reliable holder for a holster, with or without a gun. This useful apparatus also results in providing a common place for gun owners to always keep their holster and gun making the gun ownership safer to the owner's family and to the general public. The apparatus is durable, inexpensive, and easily mounted to any surface.

A preferred embodiment of the apparatus for securing a firearm comprises a landing and at least one offset. The landing is attached to the at least one offset, this can be done at the manufacturer via an injection mold. There is at least one mounting lip that is fixedly attached to the at least one offset. The at least one mounting lip provides a plurality of holes through which fasteners can pass, such as screws, nails or the like. The landing being relatively parallel to the at least one mounting lip. A gun owner can pass his or her holster clip, keeping the gun holstered, over the landing such that it is safely and securely held by the apparatus which is mounted to a surface in a known location. The apparatus can be mounted on a wall, ceiling, near a bed, in a car, in a safe, or even on a cash register to name a few examples of places where the apparatus can be mounted.

Another embodiment of the invention comprises a landing, offset and mounting lip. The landing being attached to the at least one offset and the at least one mounting lip being fixedly attached to the at least one offset, the at least one mounting lip having a plurality of holes and the landing being relatively parallel to the at least one mounting lip. This embodiment includes a sensor that is integrally attached to the landing. It includes an alarm that is electrically connected to the sensor. When a gun owner places his or her holster clip over the landing, the sensor registers that there is now a holster and gun placed on the apparatus. The sensor, being one common to the industry, is programmed to provide status of the gun's attachment to the apparatus and to signal the alarm as required, for instance if it is removed. The alarm can be of any type that is common, including sound, light, GPS, remote signaling, and the like.

Another embodiment of the present invention comprises a holster holder for clip-mounted holsters, having opposing mounting lips spaced apart from each along a mounting plane, each mounting lip having at least one mounting hole therethrough that is normal to the mounting plane. The apparatus has a landing extending between the opposing mounting lips, the landing configured to engage a clip of the holster. There are a plurality of offset components connecting the mounting lips to the landing, the offsets positioning the landing at a distance from the mounting plane. The mounting lips, offsets, and landing capturing the clip of the holster when the mounting lips are affixed to a mounting surface via fasteners through the mounting holes.

Yet another embodiment of the present invention comprises a holster holder for clip-mounted holsters which has opposing mounting lips that are spaced apart from each along a mounting plane. Each mounting lip has at least one mounting hole normal to the mounting plane. There is a landing extending between the opposing mounting lips, the landing configured to engage a clip of the holster. The apparatus has a plurality of offset components connecting the mounting lips to the landing, the offsets positioning the landing at a distance from the mounting plane. There is a holster sensor configured to detect the clip engaged with the landing and to detect absence of the clip after engagement. There is an alarm triggered by the sensor detecting removal of the clip after engagement; and the mounting lips, the offsets, and the landing capturing the clip of the holster when the mounting lips are affixed to a mounting surface via fasteners through the mounting holes.

Notably, embodiments of the present invention can have the landing extending linearly between the mounting lips or even curvilinearly between the mounting lips.

A method embodiment of the present invention comprises a method of mounting a holster to a mounting surface via a holster holder, the holster holder including opposing mounting lips, the mounting lips being spaced apart along a mounting plane, a landing extending between the mounting lips and connected to the mounting lips by respective offsets configured to position the landing at a distance from the mounting plane, the method involves attaching the holster holder to a mounting surface abutting the mounting lips. Then engaging the clip of the holster to the landing, wherein the clip is captured by the landing, the offset components, the mounting lips, and the mounting surface.

Various embodiments of the present invention allow for the landing to be made from a rigid material. It can be made from metal, plastic, wood, or any type of durable material. The landing can be made to accommodate any shape commercially necessary, for instance it might be rounded or merely rectangular and sized to be the same width as a belt. As noted, the landing is mounted to a surface via a plurality of screws passing through the plurality of holes or it can be mounted using commercially available fasteners or adhesives. The landing is best sized to allow a clip from a firearm holster to pass onto and over the landing.

BRIEF DESCRIPTION OF THE SEVERAL VIEWS OF THE DRAWINGS

These and other features, aspects and advantages of the present invention will become better understood with regard to the following description, appended claims, and accompanying drawings where:

DESCRIPTION

Overview

Figure 1:
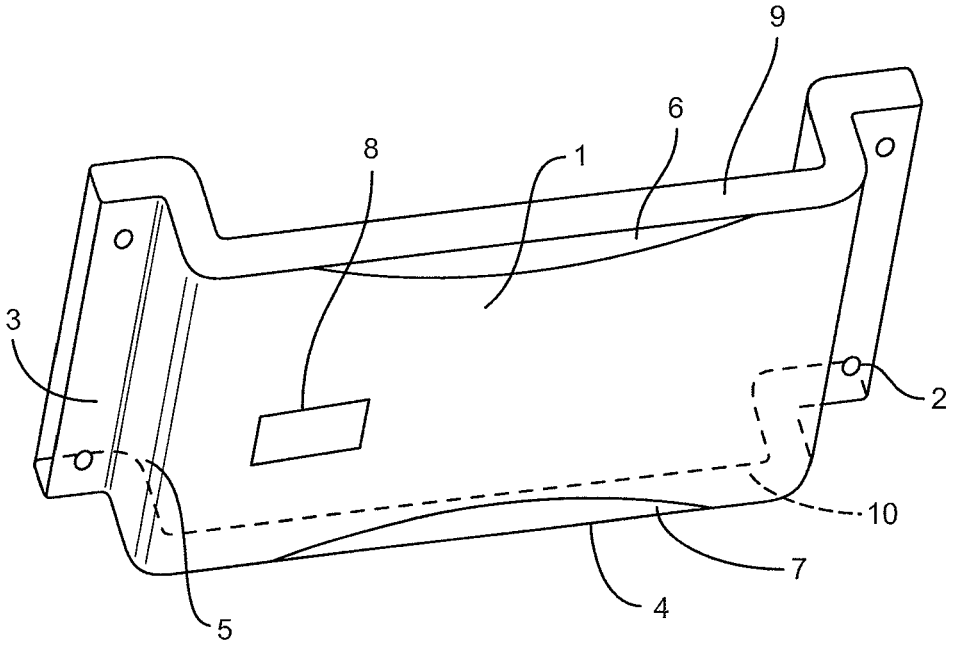
FIG. 1 shows a perspective view of the apparatus embodying features of an embodiment of the present invention.

As shown in FIG. 1, a perspective view of the apparatus embodying features of an embodiment of the present invention comprises a holder 4 having a landing 1. The landing is attached to an offset 5. The offset is attached to a mounting lip 3. The mounting lip having a plurality of holes 2. To assist the attaching and detaching of a holster to the apparatus, the landing 1 has bevels 6, 7. The landing 1 has a sensor and alarm 8 attached thereto that warns a user of activity it senses occurring on the landing 1. The landing has a first side 9 and a second side 10.

Figure 2:
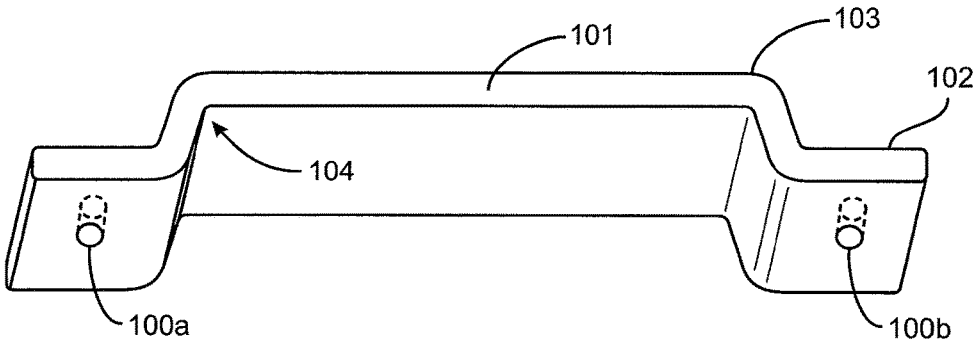
FIG. 2 shows a perspective view of the apparatus embodying features of another embodiment of the present invention.

As shown in FIG. 2, a perspective view of the apparatus embodying features of another embodiment of the present invention comprises a landing 101 attached to an offset 103. The offset 103 sets the plane of the landing 101 off from the plane of a mounting lip 102. The offset creates a space 104 suited to allow a clip from a holster to fit. The mounting lip having a plurality of holes 100 for passing screws or the like.

Figure 3:
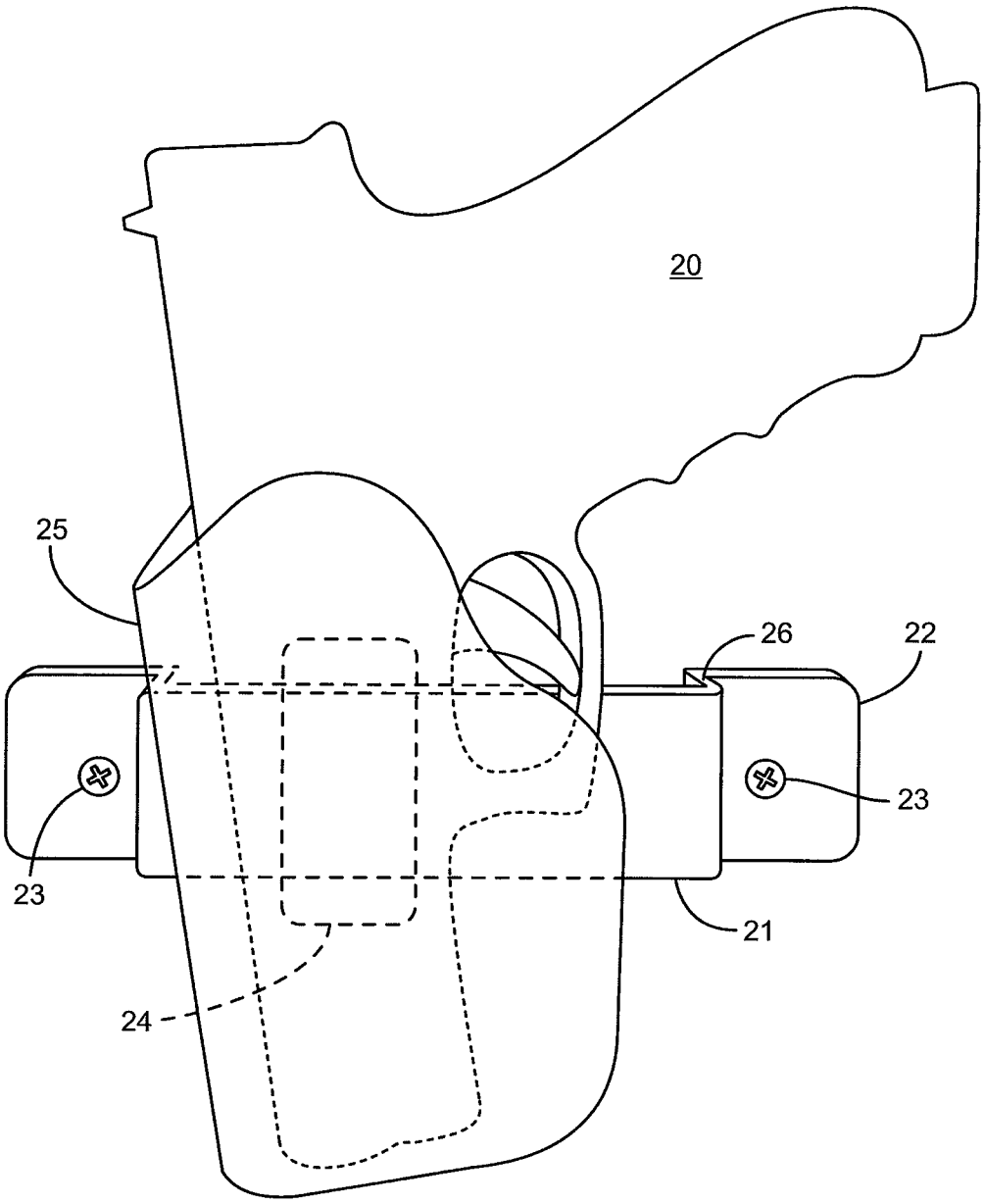
FIG. 3 shows a perspective view of the apparatus embodying features of another embodiment of the present invention with a holstered gun.

As shown in FIG. 3, a perspective view of the apparatus embodying features of another embodiment of the present invention with a holstered gun comprises a holstered gun 20. A landing 21 attached to an offset 26. The offset being attached to a mounting lip 22 which has a plurality of holes for passing screws 23. A holster 25 having a clip 24 that is clipped onto the landing 21 of the apparatus.

Although the present process has been described in considerable detail with the reference to certain preferred versions thereof, other versions are possible. For example, the landing could be shaped as a semi-circle to accommodate various sized holster clips. Or the holder could be fashioned without bevels. Therefore, the spirit and scope of the appended claims should not be limited to the description of the preferred versions contained herein.

Any element in a claim that does not explicitly state "means for" performing a specified function, or "step for" performing a specific function, is not to be interpreted as a "means" or "step" clause as specified in 35 U.S.C. § 112, ¶6.

What I claim is:

1. A holster holder for clip-mounted holsters, the holder comprising:

opposing mounting lips spaced apart from each other along a mounting plane, each mounting lip having at least one mounting hole therethrough that is normal to the mounting plane;

a landing extending a first distance between the opposing mounting lips;

the landing extending a second distance between a top edge and a bottom edge;

the first distance being more than twice the second distance;

the top edge facilitating entry into a holster clip via a bevel;

the bottom edge facilitating capture by the holster clip via another bevel;

a plurality of offset components connecting the mounting lips to the landing, the offsets positioning the landing at a third distance from the mounting plane;

the third distance being smaller than both the first and the second distance; and the mounting lips, offsets, and landing capturing the clip of the holster when the mounting lips are affixed to a mounting surface via fasteners through the mounting holes.

2. The holster holder of claim 1, wherein the landing extends linearly between the mounting lips.

3. The holster holder of claim 1, wherein the landing is made from rigid plastic.

4. The holster holder of claim 1, wherein the holder is manufactured by an injection molding process.

5. The holster holder of claim 1, wherein the holder is configured to capture the clip of the holster between the landing and a mounting surface.

6. The holster holder of claim 1, wherein the landing is configured such that the clip extends over the top edge and below the bottom edge.

7. The holster holder of claim 1, wherein the mounting lips are coplanar.

8. A holster holder for clip-mounted holsters, the holder comprising:

opposing mounting lips spaced apart from each other along a mounting plane, each mounting lip having at least one mounting hole normal to the mounting plane;

a landing extending between the opposing mounting lips;

the landing having a first beveled edge on a first side of the landing;

the landing having a second beveled edge on a second side of the landing that is situated opposite to the first side;

the beveled edges configured to facilitate easy engagement of a clip of the holster with the landing;

a plurality of offset components connecting the mounting lips to the landing, the offsets positioning the landing at a distance from the mounting plane;

a holster sensor being integrally attached to the landing;

the holster sensor configured to detect the clip engaged with the landing and to detect absence of the clip after engagement;

an alarm being electrically connected to the holster sensor;

the alarm triggered by the sensor detecting removal of the clip after engagement; and the mounting lips, the offsets, and the landing capturing the clip of the holster when the mounting lips are affixed to a mounting surface via fasteners through the mounting holes.

9. A holster holder for clip-mounted holsters, the holder comprising:

a planar mounting lip defining a mounting plane, the mounting lip having at least one mounting hole normal to the mounting plane;

at least one offset component connected to the mounting lip, the at least one offset component extending a distance away from the mounting plane;

a landing cantilevered from the at least one offset component extending away from the mounting lip along the mounting plane, the landing spaced at least the distance apart from the mounting plane by the at least one offset component;

the landing having a first beveled edge on a first side of the landing;

the landing having a second beveled edge on a second side of the landing that is situated opposite to the first side;

the beveled edges configured to facilitate engagement of a clip of the holster with the landing;

the mounting lip, the offset, and the landing supporting the clip of the holster when the mounting lip is affixed to a mounting surface via a fastener through the at least one mounting hole.

10. A holster holder for clip-mounted holsters, the holder comprising:

opposing mounting lips spaced apart from each other along a mounting plane, each mounting lip having at least one mounting hole normal to the mounting plane;

a landing extending between the opposing mounting lips, the landing configured to engage a clip of the holster;

the landing having a first beveled edge on a first side of the landing;

the landing having a second beveled edge on a second side of the landing that is situated opposite to the first side;

the beveled edges configured to facilitate easy engagement of a clip of the holster with the landing;

a plurality of offset components connecting the mounting lips to the landing, the offsets positioning the landing at a distance from the mounting plane;

a holster sensor being integrally attached to the landing;

the holster sensor configured to detect the holster held by the holster holder;

an alarm being electrically connected to the holster sensor;

the alarm triggered by the holster sensor detecting removal of the holster; and the mounting lips, the offsets, and the landing capturing the clip of the holster when the mounting lips are affixed to a mounting surface via fasteners through the mounting holes.

* * * * *